US009700773B2

(12) United States Patent
Wang

(10) Patent No.: US 9,700,773 B2
(45) Date of Patent: Jul. 11, 2017

(54) REMOVABLE GOLF BAG

(71) Applicant: Qiong Wang, Honghu (CN)

(72) Inventor: Qiong Wang, Honghu (CN)

( * ) Notice: Subject to any disclaimer, the term of this patent is extended or adjusted under 35 U.S.C. 154(b) by 75 days.

(21) Appl. No.: 14/744,014

(22) Filed: Jun. 18, 2015

(65) Prior Publication Data

US 2016/0346652 A1 Dec. 1, 2016

(51) Int. Cl.

| | |
|---|---|
| ***A63B 55/00*** | (2015.01) |
| ***A63B 55/04*** | (2006.01) |
| ***A45C 13/10*** | (2006.01) |

(52) U.S. Cl.

CPC ..... *A63B 55/04* (2013.01); *A45C 13/10* (2013.01)

(58) Field of Classification Search

CPC ..... A63B 55/00; A63B 55/04; A63B 55/40; A63B 55/408; A63B 2055/601

USPC ..... 206/315.6, 315.2, 315.3, 315.8; 248/96

See application file for complete search history.

(56) References Cited

U.S. PATENT DOCUMENTS

| | | | | |
|---|---|---|---|---|
| 2010/0051489 | A1* | 3/2010 | Shiao | A63B 55/00 206/315.7 |
| 2011/0073504 | A1* | 3/2011 | Aubery | A63B 55/00 206/315.6 |
| 2011/0162985 | A1* | 7/2011 | Shiao | A63B 55/00 206/315.8 |
| 2012/0111747 | A1* | 5/2012 | Reimers | A63B 55/00 206/315.6 |
| 2014/0034527 | A1* | 2/2014 | Anderson | A63B 55/00 206/315.6 |
| 2015/0122678 | A1* | 5/2015 | Engel | A63B 55/00 206/315.6 |

* cited by examiner

*Primary Examiner* — Sue A Weaver
(74) *Attorney, Agent, or Firm* — Wayne & King LLC

(57) ABSTRACT

The present utility model discloses a removable golf bag, comprising a bag body portion, a main frame and a base portion, wherein the part between the bag body portion and the main frame is provided with an accessory frame A, the accessory frame A is connected with the bag body portion by way of stitching, and one round of the accessory frame A exposed to the upper end of the bag body portion is provided with a small hole A, a small hole B, a small hole C and a small hole for fixing the main frame, wherein the main frame is provided with a fastener A, a fastener B, a fastener C and a fastener D matching with the small hole A, the small hole B, the small hole C and the small hole D. The accessory frame B is connected with the bag body portion by way of stitching, and one round of the accessory frame B exposed to the lower end of the bag body portion is provided with a small hole E, a small hole F, a small hole G, a small hole H, a small hole I and a small hole J for fixing the base portion, wherein the base portion is provided with a fastener E, a fastener F, a fastener G, a fastener H, a fastener I, and a fastener J matching with the small hole E, the small hole F, the small hole G, the small hole H, the small hole I and the small hole J. In the process of use of the present utility model, customer can match the bag body portion by themselves and also choose one upper frame to match several bag bodies, which not only meet customer need of assembling, disassembling and matching the golf bag by themselves, but also reduce the cost and save the resources, which is better for environment protection.

6 Claims, 7 Drawing Sheets

REMOVABLE GOLF BAG

CROSS-REFERENCE TO RELATED APPLICATIONS

This application is a continuation in part of, and claims priority to, Chinese Patent Application No. 201520364135.6 with a filing date of Jun. 1, 2015. The content of the aforementioned application, including any intervening amendments thereto, is incorporated herein by reference.

TECHNICAL FIELD

The present utility model relates generally to the recreational fitness equipment field and more specifically to a removable golf bag.

Golf bag is used to hold a golf club, and the conventional bags comprise a bag body portion, a base portion, an upper frame, and four pillars. The body portion is open at the upper end and combines with upper frame by way of rivets, the body portion is connected with the base through stitching or rivets, the removable main shaft, relying on the main shaft support bag to stand upright, is removably connected with the base and the upper frame. In short, the conventional golf bag has the following disadvantages:

The upper end of the body portion and the upper frame and the lower end of the body portion and base portion is fixed first by way of stitching and rivets, so hands of operators into assembling and disassembling the pillar is difficult when assembling the main shaft due to many lattices of upper frame.

The upper frame is fixed on the bag body portion by rivets and users can not assemble and disassemble by themselves. So the whole bag should be abandoned due when damage happens on the bag body portion or the upper frame because replacing and reasonable use is impossible.

The conventional upper frame is a whole, and there are direct openings in the outer wall ting on the frame to lift the bag, the inside and outside of outer wall should be both wrapped if the upper frame is wrapped with cloth, which is not conducive to match colors and also not beautiful.

The conventional golf bags should be fixed by rivets, which is no need in the present utility model. The golf bags according to the present utility model are fixed by way of stitching.

SUMMARY OF THE INVENTION

The present utility model aims to provide a removable golf bag to solve problems above mentioned.

To achieve the above purpose, the present utility model provides the following technical solutions.

A removable golf bag comprises a bag body portion, a main frame and a base portion, wherein the part between the bag body portion and the main frame is provided with an accessory frame A, the accessory frame A is connected with the bag body portion by way of stitching, and one round of the accessory frame exposed to the upper end of the bag body portion is provided with a small hole A, a small hole B, a small hole C and a small hole D for fixing the main frame, wherein the main frame is provided with a fastener A, a fastener B, a fastener C and a fastener D matching with the small hole A, the small hole B, the small hole C and the small hole D, the fastener A is fastened with the small hole A, the fastener B is fastened with the small hole B, the fastener C is fastened with the small hole C, the fastener D is fastened with the small hole D.

A further solution of the present utility model is that the accessory frame is provided with a large hole A, a large hole B and a large hole C, and it is easy to lift through the large hole A, the large hole B and the large hole C, moreover, the upper end of the large hole A and the large hole B is provided with a left handle and a right handle and the upper end of the large hole C is provided with a middle handle.

The accessory frame B is connected with the bag body portion by way of stitching, and one round of the accessory frame B exposed to the lower end of the bag body portion is provided with a small hole E, a small hole F, a small hole G, a small hole H a small hole I and a small hole J for fixing the base portion, wherein the base portion is provided with a fastener E, a fastener F, a fastener G, a fastener H, a fastener I, and a fastener J matching with the small hole E, the small hole F, the small hole G, the small hole H, the small hole I and the small hole J. The fastener E is fastened with the small hole E, the fastener F is fastened with the small hole F, the fastener G is fastened with the small hole G, the fastener H is fastened with the small hole H, the fastener I is fastened with the small hole I, and the fastener J is fastened with the small hole J.

A further solution of the present utility model is that a circle of groove is opened on the main frame, and the wrapper process is realized by one end of cloth into groove and the other end winding the inner wall of main frame.

A further solution of the present utility model is that the bag body portion is provided with a base portion, wherein the base portion comprises inner frame and outer frame, which is connected with the bag body portion separately by stitching, and the inner frame of base portion is connected with the outer frame through buckle.

Compared with the prior art, the advantages of the present utility model are customer can match the bag body portion by themselves and also choose one upper frame to match several bag bodies in the process of use of the present utility model, which not only meet customer need of assembling, disassembling and matching the golf bag by themselves, but also reduce the cost and save the resources, which is better for environment protection.

BRIEF DESCRIPTION OF DRAWINGS

FIG. 5 is three views of an accessory frame A of a removable golf bag according to the present utility model.

In which: 10—large hole A, 11—large hole B, 12—large hole C, 26—bag body portion, 65—main frame, 13—small hole A, 14—small hole B, 15—small hole C, 16—small hole D, 17—fastener A, 18—fastener B, 19—fastener C, 20—fastener D, 21—groove, 23—inner wall, 56—left handle, 58—right handle, 59—middle handle, 67—accessory frame B, 68—base portion, 27—small hole E, 28—small hole F, 29—small hole G, 30—small hole H, 31—small hole I, 32—small hole J, 33—fastener E, 34—fastener F, 35—fastener G, 36—fastener H, 37—fastener I, 38—fastener J, 39—slot E, 40—slot F, 41—slot G, 42—slot H, 43—slot I, 44—slot J, 74—small hole K, 75—small M, 76—small hole N, 77—small hole O, 78—small hole P, 79—small hole Q, 80—small hole R, 81—small hole S, 88—pilliar A, 86—pilliar B, 89—pilliar C, 87—pilliar D, 82—fixed block A, 83—fixed block B, 84—fixed block C, 85—fixed block D, 73—fixed slot A, 72—fixed slot B, 70—fixed slot C, 71—fixed slot D.

DETAILED DESCRIPTION OF THE PRESENT INVENTION

The following embodiments are described clearly and completely with reference to the accompanying drawings. Obviously, the described embodiments are just a part, not the whole. Other embodiments may be gained by one of ordinary skill in the art without creative work base on the embodiments of the present utility model, and the embodiments are included within the protection scope of the present invention.

Figure 1:
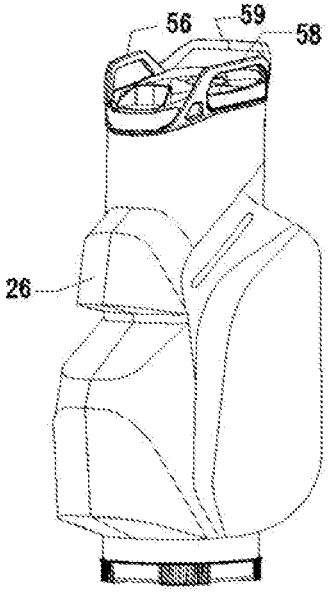
FIG. 1 is a graphic model of a removable golf bag according to the present model.
Figure 2:
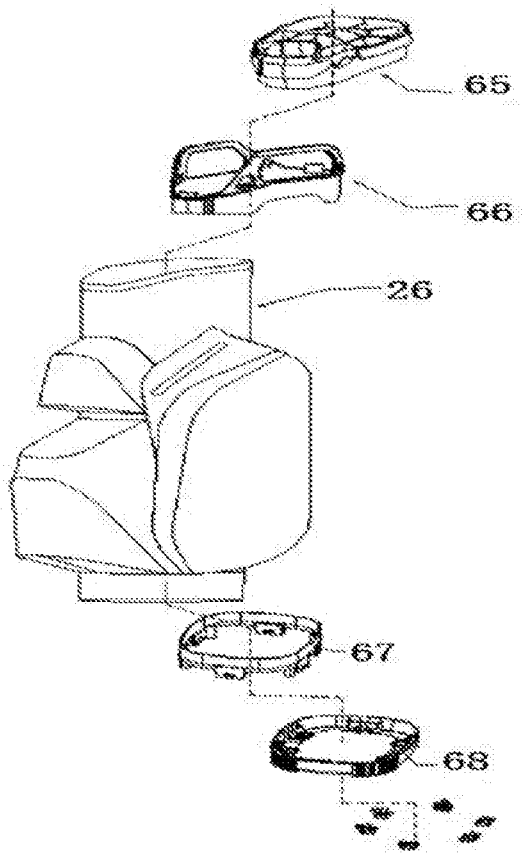
FIG. 2 is an explosive view of a removable golf bag according to the present utility model.
Figure 3:
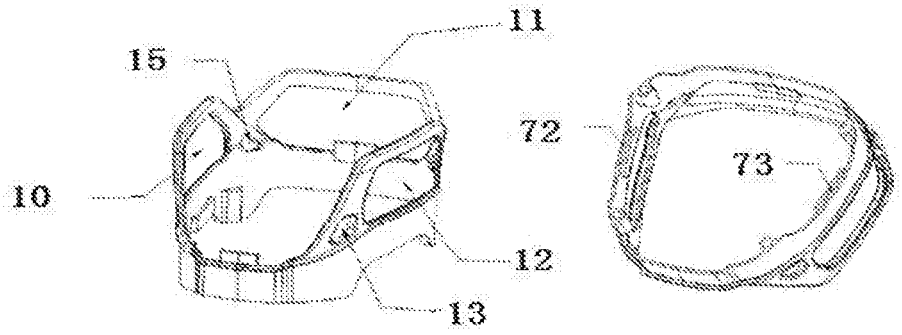
FIG. 3 is a schematic diagram of an accessory frame A of a removable golf bag according to the present utility model.
Figure 4:
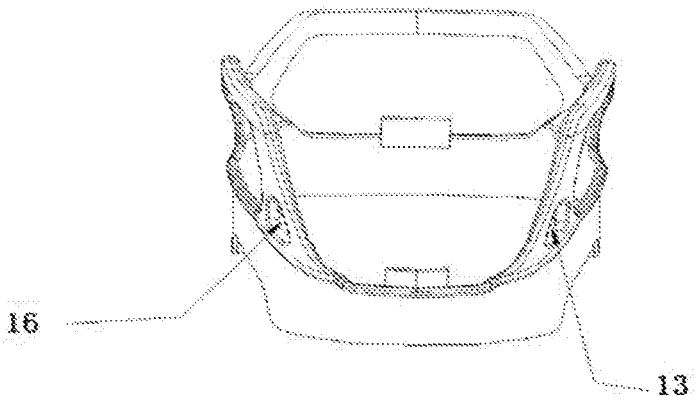
FIG. 4 is a schematic diagram a main frame of a removable golf bag according to the present utility model.
Figure 5:
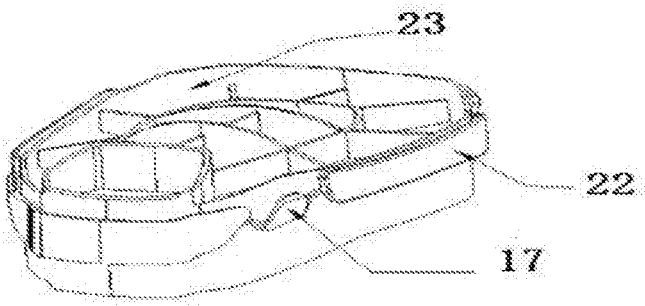
FIG. 5 is a front view of an accessory frame of a removable golf bag according to the present utility model.
Figure 6:
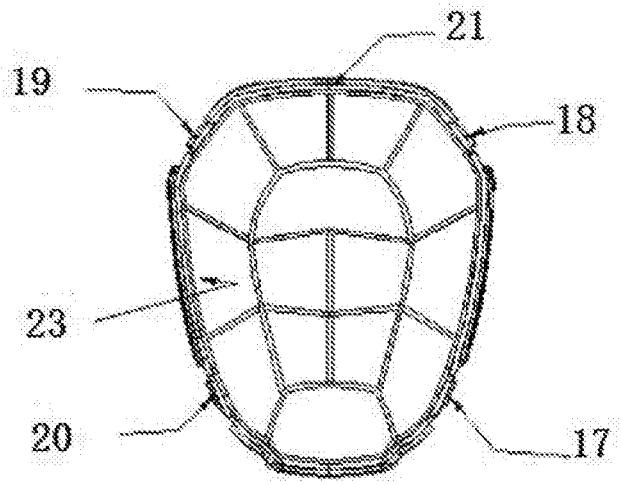
FIG. 6 is three views of a main frame of a removable golf bag according to the present utility model.
Figure 7:
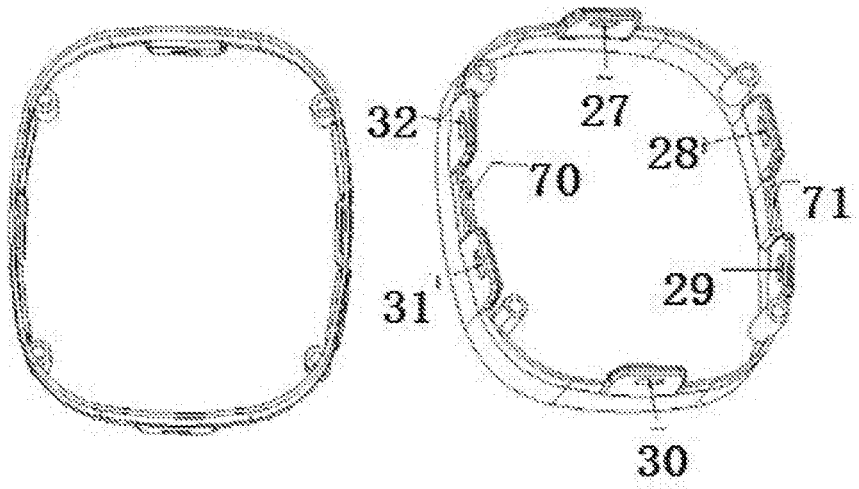
FIG. 7 is a schematic diagram of an accessory frame B of a removable golf bag according to the present utility model.
Figure 8:
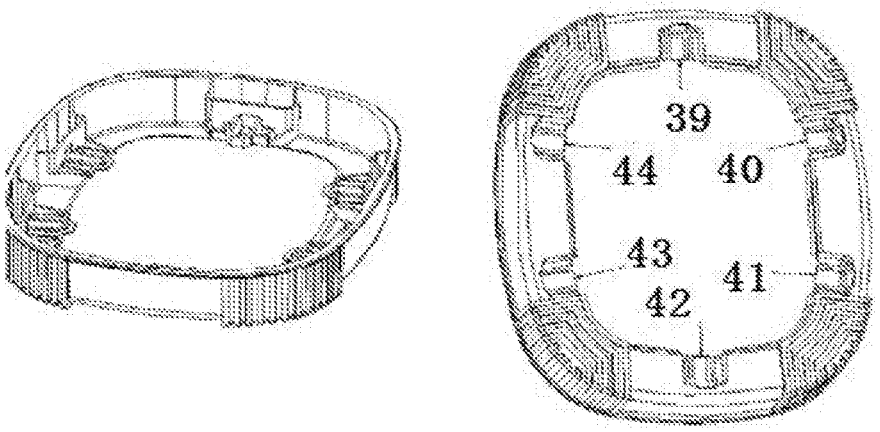
FIG. 8 is a schematic diagram of a base portion of a removable golf bag according to the present utility model.
Figure 9:
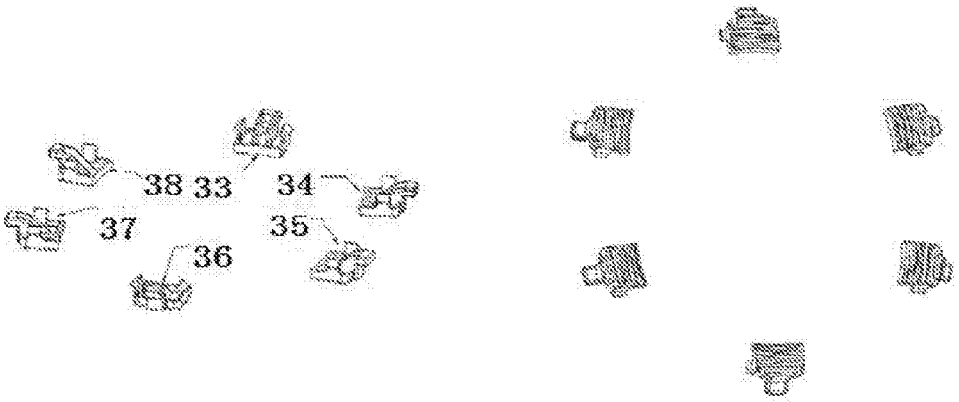
FIG. 9 is a schematic diagram of a fastener of a removable golf bag according to the present utility model.
Figure 10:
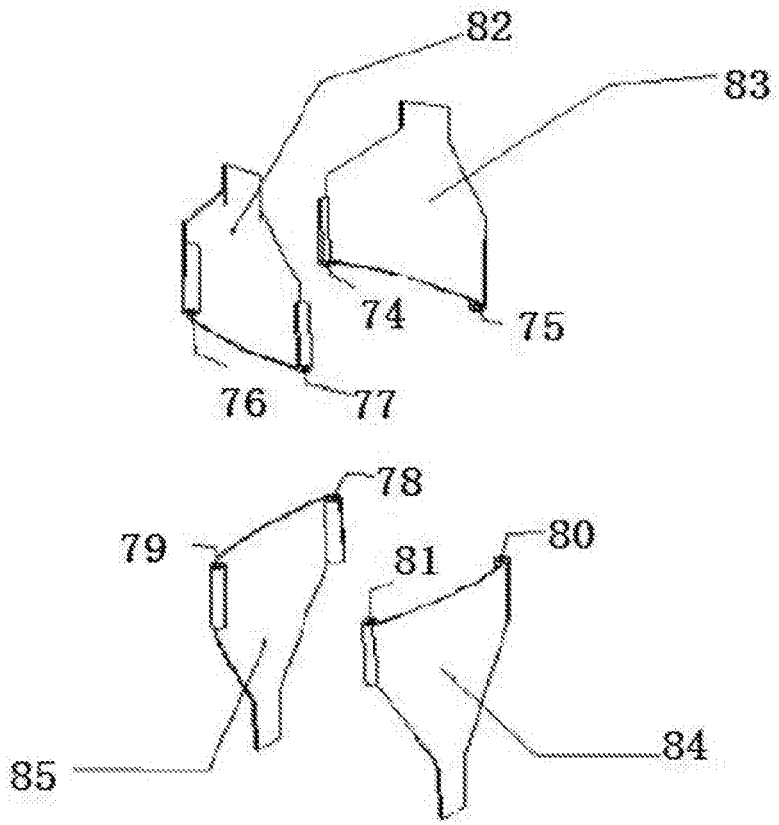
FIG. 10 is a schematic diagram of a fixed block of a removable golf bag according to the present utility model.
Figure 11:
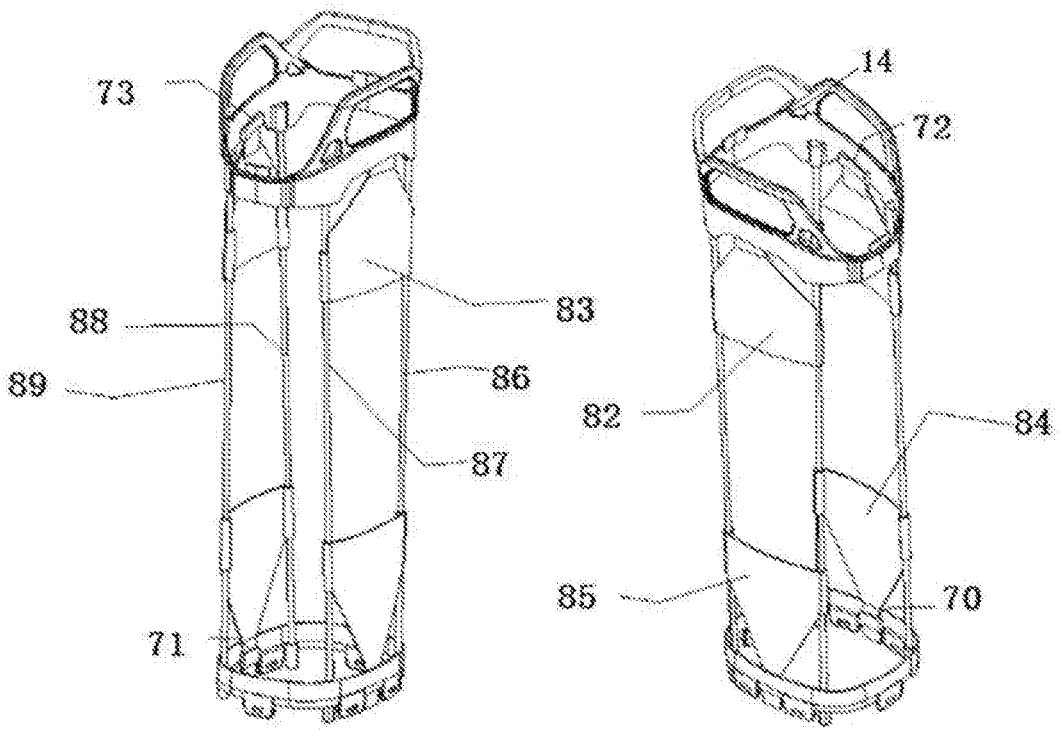
FIG. 11 is an assembly schematic diagram of a removable golf bag according to the present utility model.

Refer to FIG. 1-7, according to the present utility model, a removable golf bag comprises a bag body portion (26), a main frame (65) and a base portion (68), wherein the part between the bag body portion (26) and the main frame is provided with an accessory frame A (66), the accessory frame A (66) is connected with the bag body portion (26) by way of stitching, and one round of the accessory frame A (66) exposed to the upper end of the bag body portion is provided with a small hole A (13), a small hole B (14), a small hole C(15) and a small hole B (16) for fixing the main frame (65), wherein the main frame (65) is provided with a fastener A (17), a fastener B (18), a fastener C (19) and a fastener a (20) matching with the small hole A (13) the small hole B (14), the small hole C (15) and the small hole D (16), the fastener A (17) is fastened with the small hole A (13), the fastener B (18) is fastened with the small hole B (14), the fastener C (19) is fastened with the small hole C (15), the fastener D (20) is fastened with the small hole D (16).

The accessory frame A (66) is provided with a large hole A (10), a large hole B (11) and a large hole C (12), moreover, the upper end of the large hole A (10) and the large hole B (11) is provided with a left handle (56) and a right handle (58) and the upper end of the large hole C (12) is provided with a middle handle (59).

A circle of groove (21) is opened on the main frame (65), and the wrapper process is realized by one end of cloth into groove (21) and the other end winding the inner wall (23) of main frame (65).

The accessory frame B (67) is connected with the bag body portion by way of stitching, and one round of the accessory frame 13 exposed to the lower end of the bag body portion is provided with a small hole E (27), a small hole F (28), a small hole G (29), a small hole H (30), a small hole I (31) and a small hole J (32) for fixing the base portion, wherein the base portion is provided with a fastener E (33), a fastener (34), a fastener G (35), a fastener H (36), a fastener I (37), and a fastener J (38) matching with the small hole E (27), the small hole F (28), the small hole G (29), the small hole H (30), the small hole I (31) and the small hole J (32). The fastener E (33) is fastened with the small hole E (27), the fastener F (34) is fastened with the small hole F (28), the fastener G (35) is fastened with the small hole G (29), the fastener H (36) is fastened with the small hole H (30), the fastener I (37) is fastened with the small hole I (31), and the fastener J (38) is fastened with the small hole J (32).

The work principle of the present utility model is when the user need to disassemble the main frame (65), break the left handle (56) and right handle (58) of accessory frame 66 apart into two sides and unfasten the joint between the fastener and small hole, then the main frame (65) can be removed. When disassemble the base portion (68), all the user need to do is break the fastener E (33), fastener F (34), fastener G (35), fastener H (36), fastener I (37), and fastener J (38) on the base portion (68) apart into the middle of the base portion (68), and unfasten the joint between the fastener and small hole, then the base portion (68) can be removed.

The base portion (68) is connected with the accessory frame B (67) through fasteners, the base portion (68) is provided with a slot E (39), a slot F (40), a slot G (41), a slot H (42), a slot I (43) and a slot J (44). The base portion (68) is provided with a fastener E (33), a fastener F (34), a fastener G (35), a fastener H (36), a fastener I (37) and a fastener J (38) matching with the slot E (39), the slot F (40), the slot G (41), the slot H (42), the slot I (43) and the slot J (44), the slot E (39) is fastened with the fastener E (36), the slot F (40) is fastened with the fastener F (34), the slot G (41) is fastened with the fastener G (35), the slot H (42) is fastened with the fastener H (36), the slot I (43) is fastened with the fastener I (37), and the slot J (44) is fastened with the fastener J (38), a fixed block A (82) and a fixed block B (83) are added between the accessory frame A (66) and four pillars, and a fixed block C (84) and a fixed block D (85) are added between the accessory frame B (67) and four pillars, the upper end of the fixed block A (82) is fastened with the fixed slot A (73) of the accessory frame A (66), the upper end of the fixed block B (83) is fastened with the fixed slot B (72) of the accessory frame A (66), the lower end of the fixed block C (84) is fastened with the fixed slot C (70) of the accessory frame A (66), the lower end of the fixed block D (85) is fastened with the fixed slot D (71) of the accessory frame A (66), the small hole K (74), small hole M (75), small hole N (76), small hole O (77), small hole P (78), small hole Q (79), small hole R (80) and small hole S (81) are fixed with four pillars A (88), B (86), C (89) and D (87) separately.

The base portion (68) includes a base and an accessory frame B, the accessory frame B is connected with the bag body portion by way of stitching, and the base portion is connected with the accessory frame B through buckles.

For the skilled in the art, the present utility model is not limited to details of above embodiments, moreover, the present utility model can be realized by other forms without departing from the spirit and fundamental features of the present utility model. So the embodiments should be regarded as the model rather than limited ones in every aspect. The scope of the present utility model is limited by accompanied claims rather than above description, so any variations that fall into the equivalents elements of claims within the contents and scope shall be included in the present utility model. Any marks in the accompanied drawing according to the claim should not be regarded as the limitation of involved claims.

Besides, it should be understood that not every embodiment merely includes one independent technical solution, the ways of description as embodiments is merely for clear description, the skilled in the art should regard the description as a whole and the technical solutions in each embodiments ran be combined pro properly to form other embodiments that the skilled in the art can understand.

I claim:

1. A removable golf bag, comprising:

a bag body portion (26), a main frame (65) and a base portion (68), wherein a part between the bag body portion (26) and the main frame (65) is provided with an accessory frame (66), the accessory frame (66) is stitched with the bag body portion, and one round of the accessory frame (66) exposed to an upper end of the bag body portion (26) is provided with a small hole (13), a small hole (14), a small hole (15) and a small hole (16) for fixing the main frame (65), wherein the main frame (65) is provided with a fastener (17), a fastener (18), a fastener (19) and a fastener (20) matching with the small hole (13), the small hole (14), the small hole (15) and the small hole (16), the fastener (17) is fastened with the small hole (13), the fastener (18) is fastened with the small hole (14), the fastener (19) is fastened with the small hole (15), the fastener (20) is fastened with the small hole (16), wherein the accessory frame (66) is provided with a large hole (10), a large hole (11) and a large hole (12), and the upper end of the large hole (10) and the large hole (11) is provided with a left handle (56) and a right handle (58) and the upper end of the large hole (12) is provided with a middle handle (59).

2. The removable golf bag of claim 1, wherein an accessory frame (67) is stitched with the bag body portion (26), and one round of the accessory frame (67) exposed to a lower end of the bag body portion (26) is provided with a small hole (27), a small hole (28), a small hole (29), a small hole (30), a small hole (31) and a small hole (32) for fixing the base portion (68), wherein the base portion (68) is provided with a fastener (33), a fastener (34), a fastener (35), a fastener (36), a fastener (37), and a fastener (38) matching with the small hole (27), the small hole (28), the small hole (29), the small hole (30), the small hole (31) and the small hole (32).

3. The removable golf bag of claim 1, wherein the base portion (68) is connected with the accessory frame (67) through fasteners, the base portion (68) is provided with a slot (39), a slot (40), a slot (41), a slot (42), a slot (43) and a slot (44), wherein the base portion is provided with a fastener (33), a fastener (34), a fastener (35), a fastener (36), a fastener (37) and a fastener (38) matching with the slot (39), the slot (40), the slot (41), the slot (42), the slot (43) and the slot (44), wherein a fixed block (82) and a fixed block (83) are added between the accessory frame (66) and four pillars, and a fixed block (84) and a fixed block (85) are added between the accessory frame (67) and four pillars.

4. The removable golf bag of claim 1, wherein a circle of groove is opened on the main frame (65).

5. The removable golf bag of claim 1, wherein the lower end of the bag body portion (26) is provided with a base portion (68), wherein the base portion (68) comprises an accessory frame (67), wherein the accessory frame (67) is stitched with the bag body portion (26).

6. The removable golf bag of claim 1, wherein the accessory frame (66), the left handle (56), the right handle (58) and the middle handle (59) are integrally formed as a single piece.

* * * * *